US006755258B1

(12) United States Patent
Hunke et al.

(10) Patent No.: US 6,755,258 B1
(45) Date of Patent: Jun. 29, 2004

(54) AERIAL LADDER FIRE FIGHTING APPARATUS WITH POSITIONABLE WATERWAY

(75) Inventors: Jeffrey A Hunke, Snyder, NE (US); Thomas Smeal, Snyder, NE (US)

(73) Assignee: Smeal Fire Apparatus Co., Snyder, NE (US)

( * ) Notice: Subject to any disclaimer, the term of this patent is extended or adjusted under 35 U.S.C. 154(b) by 0 days.

(21) Appl. No.: 10/351,532

(22) Filed: Jan. 27, 2003

(51) Int. Cl.[7] ..... A62C 27/00
(52) U.S. Cl. ..... 169/24; 239/159
(58) Field of Search ..... 169/24, 25; 239/159, 239/165, 172, 280, 280.5, 281

(56) References Cited

U.S. PATENT DOCUMENTS

| | | | | | |
|---|---|---|---|---|---|
| 3,206,126 | A | | 9/1965 | Thompson | |
| 3,346,052 | A | | 10/1967 | Moore et al. | |
| 3,599,722 | A | | 8/1971 | Davidson | |
| 3,675,721 | A | * | 7/1972 | Davidson et al. | 169/24 |
| 3,770,062 | A | | 11/1973 | Riggs | |
| 3,777,845 | A | * | 12/1973 | Ashworth | 182/17 |
| 3,789,869 | A | * | 2/1974 | Morris | 137/351 |
| 4,007,793 | A | | 2/1977 | Hux et al. | |
| 4,317,504 | A | * | 3/1982 | Artaud et al. | 182/66.2 |
| 4,453,672 | A | * | 6/1984 | Garnett | 239/166 |
| 4,678,041 | A | * | 7/1987 | Staudinger | 169/24 |
| 4,834,215 | A | * | 5/1989 | Smeal | 182/66.2 |
| 5,389,031 | A | * | 2/1995 | Sharpe et al. | 446/409 |
| 5,437,345 | A | | 8/1995 | Schmidt et al. | |
| 5,788,158 | A | | 8/1998 | Relyea | |
| 6,006,841 | A | * | 12/1999 | Hunke | 169/24 |
| 6,421,593 | B1 | * | 7/2002 | Kempen et al. | 701/48 |
| 6,446,731 | B1 | * | 9/2002 | Sorosky | 169/24 |

FOREIGN PATENT DOCUMENTS

| | | | |
|---|---|---|---|
| DE | 3810359 C2 | * | 10/1989 |
| DE | 3942378 A | * | 7/1990 |
| JP | 08155049 A | * | 6/1996 |

* cited by examiner

*Primary Examiner*—William E. Tapolcai
*Assistant Examiner*—Mohammad M. Ali
(74) *Attorney, Agent, or Firm*—Pillsbury Winthrop LLP

(57) ABSTRACT

A fire fighting apparatus includes a frame supported by wheels and a sectioned ladder assembly mounted on the frame for movement between stored and raised positions. The sections of the ladder assembly extend and retract. A waterway on the ladder assembly includes a fluid inlet connection and a water outlet structure for directing pressurized fluid. A lock member is operable to connect the waterway and a top ladder section so that the water outlet structure moves with the top ladder section as the top ladder section extends and retracts and to disconnect the waterway from the top ladder section to enable the water outlet structure to remain substantially stationary with respect to an adjacent ladder section as the top section extends and retracts. A control mounted on the frame at a location remote from the ladder assembly controls the lock member.

22 Claims, 11 Drawing Sheets

AERIAL LADDER FIRE FIGHTING APPARATUS WITH POSITIONABLE WATERWAY

FIELD OF THE INVENTION

The present invention relates to fire fighting apparatuses. More specifically, illustrative embodiments of the invention relate to waterways mounted on aerial ladders for delivering fire fighting fluids to extinguish fires.

BACKGROUND

Fire fighters often use aerial ladder assemblies while fighting fires. An aerial ladder assembly is typically mounted on a frame of a fire fighting apparatus (e.g., a frame of a fire truck) for angular raising and lowering movements between a generally horizontal storage position on the frame and a raised position in which the ladder assembly extends upwardly at an angle from the frame. The ladder assembly is comprised of a plurality of ladder sections which are movably coupled to one another. The ladder assembly can be extended and retracted by extending and retracting the ladder sections.

Fire departments use aerial ladder assemblies to carry out a variety of fire fighting activities. For example, aerial ladder assemblies may be used to rescue people trapped on the upper floors of burning buildings. Fire fighters may also use an aerial ladder assembly in various ways to ventilate a building. For instance, fire fighters may use the aerial ladder assembly to climb onto a building roof to cut ventilation openings through the roof.

An aerial ladder assembly may also be used as a support structure for supporting and positioning a waterway. A waterway is a mechanism which may be used to transmit a fire fighting fluid to the location of a fire and which may be operable to direct a stream of a pressurized fire fighting fluid onto, for example, a burning building to knockdown or extinguish a fire. The waterway is in fluid communication with a source of a fire fighting fluid (e.g., water supplied from a fire hydrant, foams for chemical or electrical fires, etc.) and is operable to convey the fire fighting fluid to a water outlet structure (e.g., a monitor and nozzle assembly, a monitor alone, or a nozzle alone) at the terminal end of the waterway. The nozzle is operable to help pressurized and/or shape the stream of water emitted by the water outlet structure. The monitor is vertically and horizontally adjustable to aim the stream of water. The water outlet structure of the waterway may be operated to emit a continuous stream of fire fighting fluid. The angle and/or orientation of the water outlet structure may be adjusted to aim the fluid stream.

The water outlet structure may be located in a range of positions along the length of an extended ladder assembly. For example, the water outlet structure may be positioned at the tip or terminal end of the top or fly ladder section of a ladder assembly or may be mounted at an intermediate position of the ladder assembly. Positioning the water outlet structure at the tip of the top ladder section maximizes the reach of the fluid stream. Positioning the water outlet structure of the waterway at an intermediate location on the ladder assembly provides the ladder assembly with a "clean" aerial tip which may be important in instances in which the ladder assembly is used to carry out rescue operations and/or ventilation operations.

It is known to provide an aerial ladder assembly with a positionable monitor and nozzle assembly. A positionable monitor and nozzle assembly is an assembly that can be repositioned along the length of the ladder assembly. A positionable monitor and nozzle assembly can be positioned at the terminal end of the ladder assembly or at an intermediate location on the ladder assembly. Currently available waterways with positionable monitor and nozzle assemblies require a fire fighter to walk or climb to the location of the monitor and nozzle assembly and manually connect the assembly to the desired ladder section so that the nozzle of the monitor and nozzle assembly is in the desired position when the ladder assembly is extended. Climbing a ladder assembly to reposition the monitor and nozzle assembly is inconvenient, time consuming and exposes the fire fighter to a risk of injury.

SUMMARY

The present invention may be embodied in an aerial type fire fighting apparatus that includes a frame rollingly supported by a plurality of wheels for enabling the apparatus to be transported to a location of a fire and an extendible and retractable ladder assembly comprising at least two ladder sections including a top ladder section. The ladder sections are movably mounted to one another such that in each pair of adjacent ladder sections an upper one of the pair can be extended and retracted relative to a lower one of the pair to thereby affect extension and retraction of the ladder assembly. The ladder assembly is movably mounted for raising and lowering movements between a generally horizontal stored position on the frame and a raised position wherein the ladder assembly extends upwardly at an angle from the frame. A power-operated ladder raising and lowering mechanism is operatively connected to the ladder assembly. The ladder raising and lowering mechanism is constructed and arranged to move the ladder assembly under power between the generally horizontal stored position thereof and the raised position thereof. A power-operated ladder extending and retracting mechanism is operatively connected to the ladder assembly. The ladder extending and retracting mechanism is constructed and arranged to extend and retract the ladder sections under power to thereby affect extension and retraction of the ladder assembly. The fire fighting apparatus further includes a waterway comprising a water outlet support member coupled to the ladder assembly, a water outlet structure supported on the water outlet support member, and a fluid inlet connection. The fluid inlet connection is configured to be coupled to a source of a fire fighting fluid, such as a fire hydrant or a storage tank in a separate pump truck or in the vehicle itself. The fluid inlet connection is in fluid communication with the water outlet structure. The water outlet structure is constructed and arranged to direct pressurized fire fighting fluid therefrom when the fluid inlet connection is fluidly connected to a supply of pressurized fire fighting fluid. A lock member is movable between (a) a first position in which the lock member couples the water outlet support member, the water outlet support member and the top ladder section to one another such that the water outlet support member and the water outlet structure move with the top ladder section as the top ladder section is extended and retracted relative to its adjacent ladder section, and (b) a second position in which the water outlet support member is disconnected from the top ladder section to enable the water outlet support member and the water outlet structure to remain substantially stationary with respect to the ladder section adjacent the top ladder section as the top ladder section is extended and retracted relative to its adjacent ladder section. The fire fighting apparatus also includes a remotely controlled actuator mechanism having a manually operable control mounted on the frame at a location remote from the lock member. The actuator mechanism is operatively connected to the lock member and is constructed and arranged to move the lock member between the first and second positions thereof responsive to remote manual operation of the manually operable control.

Other aspects, features, and advantages of the present invention will become apparent from the following detailed description of the illustrated embodiments, the accompanying drawings, and the appended claims.

DETAILED DESCRIPTION

Figure 1:
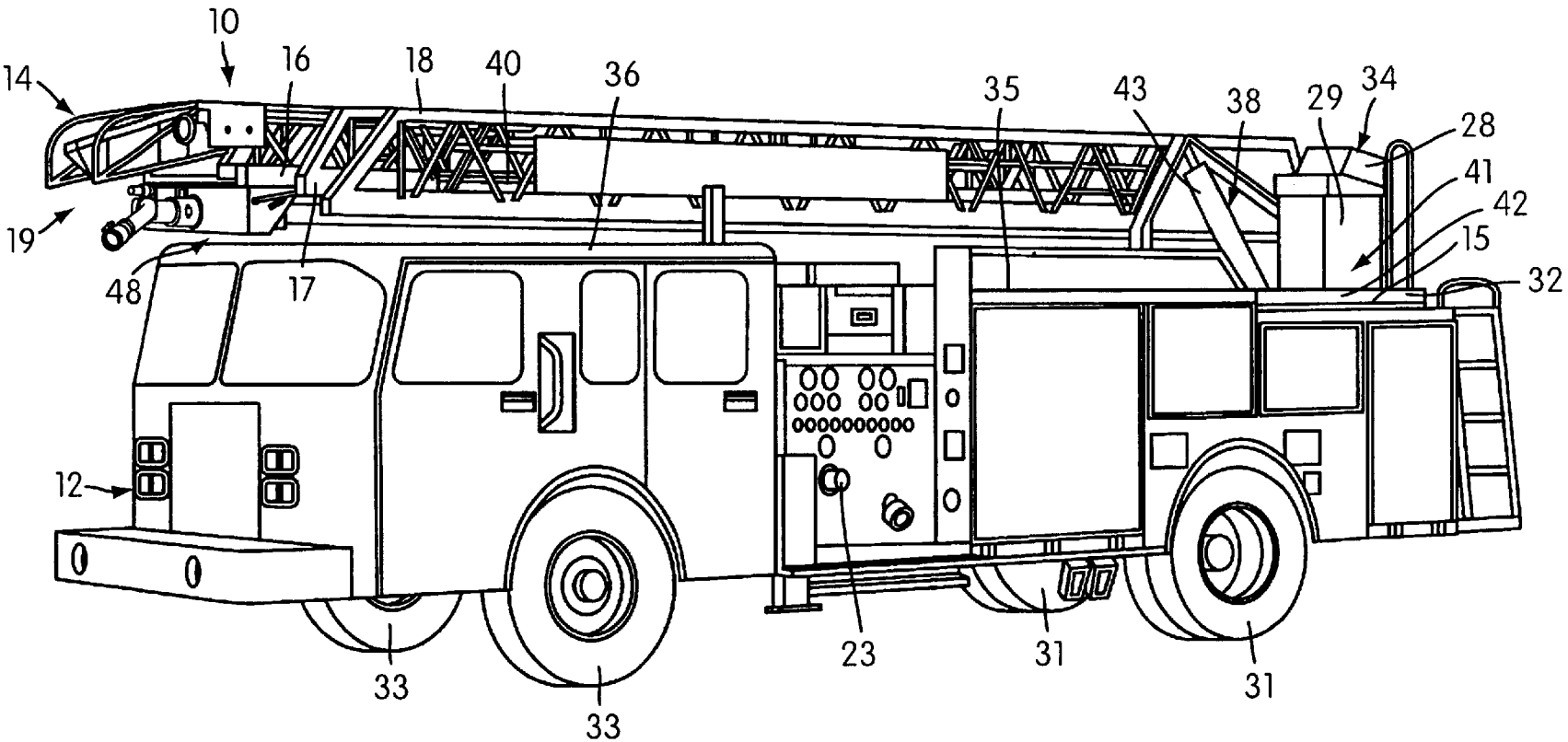
FIG. 1 is a perspective view of an illustrative embodiment of a fire fighting apparatus that includes an aerial ladder assembly.

FIG. 1 shows an illustrative embodiment of a fire fighting apparatus 10 which illustrates principles of the present invention. The apparatus 10 includes a self-propelled aerial vehicle 12 and an aerial ladder assembly 14. The aerial ladder assembly 14 is movably mounted on a frame 15 of the vehicle 12 for raising and lowering movements with respect to the vehicle frame 15 and for rotational movement with respect to the frame 15. More specifically, the ladder assembly 14 is mounted on a swivel mechanism 41 which is in turn mounted on the frame 15. The ladder assembly 14 is mounted on the swivel mechanism 41 for pivotal movement between a generally horizontal stored position on the frame 15 and a raised position in which the ladder assembly 14 extends generally upwardly and at an angle from the frame 15. The swivel mechanism 41 is operable to swivel the raised ladder assembly 14 with respect to the frame 15.

The ladder assembly 14 includes a plurality of ladder sections that can be extended and retracted. The illustrative ladder assembly 14 is comprised of three ladder sections including a first or top ladder section 16, a second or intermediate ladder section 17, and a third or bottom ladder section 18. It can be appreciated, however, that the particular ladder assembly 14 used to illustrate the invention is an example only and is not intended to limit the scope or the applicability of the invention to the particular ladder assembly 14 shown. For example, the number of ladder sections included in the ladder assembly, the construction of each ladder section, and the manner in which the ladder sections are mounted to one another is not of particular importance to the illustration or the explanation of the invention. It can be understood, therefore, that the invention may be practiced with any suitable ladder arrangement.

The ladder sections 16–18 of the example ladder assembly 14 are movably coupled to one another in series to enable the ladder assembly 14 to be extended and retracted by moving the ladder sections 16–18 with respect to one another. Specifically, the top ladder section 16 is immediately adjacent to and movably coupled to the intermediate ladder section 17 and the intermediate ladder section 17 is immediately adjacent to and movably coupled to the bottom ladder section 18. The top and intermediate ladder sections 16, 17 and the intermediate and bottom ladder sections 17, 18 comprise a series of adjacent pairs of ladder sections.

The ladder sections 16–18 are slidably mounted in telescopic nested relation to one another such that in each pair of adjacent ladder sections 16, 17 and 17, 18, an upper ladder section of the pair can be extended relative to a lower ladder section of the pair to thereby affect extension and retraction of the ladder assembly 14. The ladder sections 16–18 of the particular ladder assembly 14 illustrated are operatively coupled to one another such that when the ladder assembly 14 is extended, all of the ladder sections 16–18 extend simultaneously and proportionately relative to one another; and when the ladder assembly 14 is retracted, all of the ladder sections 16–18 retract simultaneously and proportionately relative to one another.

The fire fighting apparatus 10 includes a waterway 19 that is operable to transmit a continuous supply of fluid to a desired location. The waterway 19 has a fluid inlet connection 23 at one end and a water outlet structure at an opposite end. The particular water outlet structure illustrated includes a monitor 25 and a nozzle 22, but this is illustrative only and not intended to limit the scope of the invention. The nozzle 22 is operable to help pressurize and/or shape a continuous stream of a fire fighting fluid from the terminal end of the waterway 19 toward a target area such as a burning building. The monitor 25 is operable to support and control the orientation of the nozzle 22 to control the direction of the stream of pressurized fire fighting fluid. The monitor 25 may be horizontally and vertically adjusted to aim the stream of fluid emitted from the nozzle 22. The monitor 25 can be used alone without the nozzle 22 (e.g., in instances in which a hose is attached to the end of the waterway 19, for example). The nozzle may in some instances be used without a monitor 25. The fluid inlet connection 23 is illustrated as a coupling mechanism which may be mounted on the side of the fire fighting apparatus 10 (as shown), on a back of the apparatus 10, or at any other appropriate location. The illustrated fluid inlet connection 23 is configured to be connected to a source of a fire fighting fluid and is in fluid communication with the nozzle 22 through a continuous fluid passageway that may be of conventional construction.

The fluid inlet connection 23 can be connected to a wide range of fluid sources (e.g., a hydrant, a pump truck) to supply the waterway 19 with a wide range of pressurized fire fighting fluids (e.g., water, a foam, etc.). For example, the fluid inlet connection 23 may be connected through a hose to a supply of water supplied by a fire hydrant or other water source. In an instance in which the waterway 19 is connected to a water source, a continuous stream of water flows from the water source, into the fluid inlet connection 23 and outwardly of the nozzle 22. The nozzle 22 is operable to direct the continuous stream of the pressurized fluid on or into a burning structure. The term fluid inlet connection encompasses any inlet connection that enables fluid to flow into the waterway and is not limited to the one illustrated. For example, the fluid inlet connection could be made to a fluid reservoir in the vehicle.

The continuous fluid passageway between the fluid inlet connection 23 and the nozzle 22 includes a series of telescopically interengaged tubular sections including tubular sections 88 and 89 that are disposed along the length of the ladder assembly 14. The tubular sections 88, 89 extend and retract as the ladder assembly 14 is moved between extended and retracted conditions and cooperate with one another to provide a continuous fluid passageway along the length of the ladder assembly 14. The tubular sections 88, 89 received fire fighting fluid communicated from the fluid inlet connection 23 and transmit the fire fighting fluid to the nozzle 22.

The waterway 19 further includes a water outlet support member 48 that is mounted on the ladder assembly 14. The water outlet support member 48 supports the water outlet structure (i.e., the monitor 25 and the nozzle 22) and a portion of the tubular sections 88, 89. More specifically, the tubular sections 88, 89 are partially supported by the water outlet support member 48 and by one or more support members 92 mounted on the ladder assembly 14.

Figure 11:
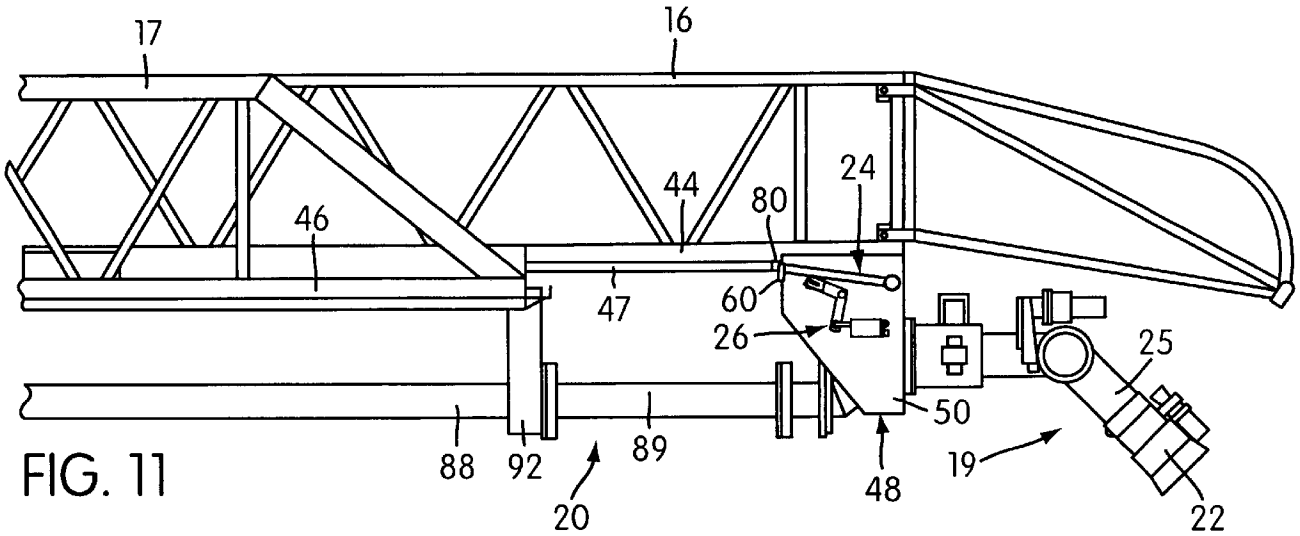
FIG. 11 is a view similar to the view of FIG. 9 except showing the top ladder section in a partially extended position.
Figure 12:
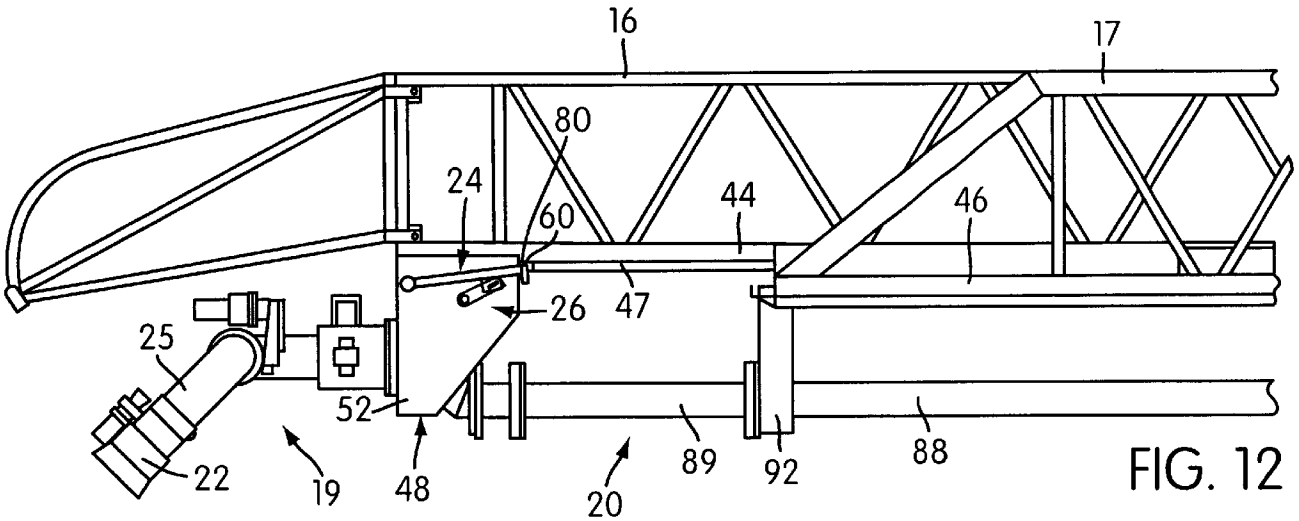
FIG. 12 is a view similar to the view of FIG. 11 except showing an opposite side of the ladder assembly.

A lock member 24 is operable to releasably couple or connect the water outlet support member 48 and hence the water outlet structure (including the monitor 25 and the nozzle 22) to a selected ladder section. In the illustrative embodiment, the lock member 24 is operable to releasably couple the water outlet support member 48 to either the top ladder section 16 or the intermediate ladder section 17 of the ladder assembly 14. When the water outlet support member 48 is coupled to the intermediate ladder section 17, the monitor 25 and the nozzle 22 moves with the intermediate ladder section 17 as the intermediate ladder section 17 is extended and retracted with respect to the bottom and top ladder sections 18, 16 (see, for example, FIGS. 8 and 9). Thus, when the water outlet support member 48 is coupled to the intermediate ladder section 17, the top section 16 can be moved between its extended and retracted positions without moving the water outlet support member 48 with respect to intermediate ladder section 17. When the water outlet support member 48 is releasably coupled to the top ladder section 16, the water outlet support member 48 (and, therefore, the monitor 25 and the nozzle 22) moves with the top ladder section 16 as the top ladder section 16 moves relative to the adjacent ladder sections 17, 18 between its extended and retracted positions (see, for example, FIGS. 11 and 12).

An actuator mechanism 26 is mounted on the ladder assembly 14 and is operatively connected to the lock member 24. The actuator mechanism 26 is operable to move the lock member 24 between releasably coupled engagement with the top ladder section 16 and releasably coupled engagement with the intermediate ladder section 17.

The actuator mechanism 26 is controlled remotely so that the coupling between the water outlet support member 48 and the various sections of the ladder assembly 14 can be changed by a fire fighter from a location remote from the lock member 24. As explained below, the apparatus 10 includes a control assembly 28 which may be mounted on the frame of the apparatus 10, on the swivel mechanism 41, or at any other appropriate remote location. The control assembly 28 includes a plurality of controls and indicators that are operable to monitor and control the operation of the lock member 24 and thus the coupling of the water outlet support member 48 with the various sections of the ladder assembly 14.

In the illustrative embodiment, the operation of the actuator mechanism 26 may be carried out by manually adjusting a manually operable control that is part of the control assembly 28. The control assembly 28 may be located at any convenient location remote from the lock member 24 and is not restricted to being located on the vehicle frame or the swivel mechanism 41. The example control assembly 28 is located on an upstanding structure or pedestal 29 that is mounted on the swivel mechanism 41 adjacent the ladder assembly 14.

Because a fire fighter can access the control assembly 28 without having to climb or to be on the ladder assembly 14, a fire fighter is able to determine which ladder section the water outlet support member 48 is coupled to and to change the coupling between the water outlet support member 48 and the ladder sections without having to climb up or walk to the free end of the retracted ladder assembly 14. In this particular embodiment of the invention, the fire fighter is able to determine the position of the lock member 24 and to change the coupling while the fire fighter is standing on the swivel mechanism 41 of the vehicle 12.

This positioning of the control assembly 28 is intended to be an example only and is not intended to limit where in or on the vehicle 12 the control assembly 28 can be located. The control assembly 28 can be located at any location on the vehicle 12 that is remote from the lock member 24. For example, the control assembly 28 can be located at a location remote from the ladder assembly 14 such as, for example, on the exterior of the vehicle 12 (including on the turntable 42 or on the frame of the vehicle) or on the interior of the vehicle 12, or both (in an instance in which multiple control assemblies are installed in or near the fire fighting apparatus 10.

The aerial vehicle 12 may be in the form of a Smeal Aerial Quint Apparatus Model 2003 manufactured by Smeal Fire Apparatus Co. of Snyder, Nebr. modified in a manner described herein to accomplish the selective coupling of the water outlet support member 48 to various ladder sections of the ladder assembly 14 through the manipulation of a control mechanism or assembly located at the location remote from the lock member 24. The present invention may be practiced, however, utilizing any aerial type of fire fighting apparatus.

The frame 15 of the aerial vehicle 12 is rollingly supported by a plurality of ground-engaging drive wheels 31 and steerable wheels 33. An internal combustion engine is operatively connected in driving relation to the drive wheels 31 by a transmission mechanism. The vehicle 12 includes control systems for operating the engine and the transmission and includes a steering control mechanism to steer the steerable wheels 33 to enable the fire fighting apparatus 10 to be transported to the location of a fire.

The frame 15 provides a rearward upper deck 32 on which the aerial ladder assembly 14 is mounted. The aerial ladder assembly 14 is shown in its stored position in FIG. 1. The ladder assembly 14 is movably mounted on the rearward upper deck 35 by a ladder mounting and operating assembly 34. When the ladder assembly 14 is in its stored position, the ladder assembly 14 extends forwardly from the ladder mounting and operating assembly 34 and a forward portion of the ladder assembly 14 is supported by an upwardly facing surface of a forward cab section 36 of the vehicle 12.

The ladder mounting and operating assembly 34 may include a power-operated ladder raising and lowering mechanism 38, a power-operated ladder extending and retracting mechanism 40, and the power-operated rotating or swivel mechanism 41. The power-operated ladder raising and lowering mechanism 38 is operatively connected to the ladder assembly 14 and is operable to pivot the ladder assembly 14 under power upwardly out of its generally horizontal stored position through a range of operative raised angular positions and to move the ladder assembly 14 back into its stored position. The power-operated ladder extending and retracting mechanism 40 is operatively connected to the ladder assembly 14 and is operable to partially or fully extend the ladder sections 16–18 and to retract the ladder sections 16–18 under power to thereby affect partial or full extension and retraction of the ladder assembly 14. The swivel mechanism 41 is operable to swivel or rotate the raised ladder assembly 14 angularly with respect to the frame 15.

The raising and lowering mechanism 38, the extending and retracting mechanism 40 and the swivel mechanism 41 can be operated in a cooperative manner to move the ladder assembly 14 out of its stored position and into a multiplicity of operative positions and to move the ladder assembly 14 back into its stored position. The swivel mechanism 41 may include a power-operated turntable 42 that supports the ladder assembly 14, the raising and lowering mechanism 38, and the extending and retracting mechanism 40. The turntable 42 is rotatably or pivotally mounted on the rearward upper deck 32 of the frame 15 of the fire fighting apparatus 10 for power operated movement with respect to the vehicle frame 15 so that the ladder assembly 14 can be swiveled with respect to the frame 15 by turning the turntable 42.

The raising and lowering mechanism 38, the extending and retracting mechanism 40, and the swivel mechanism 41 may each be independently powered by any suitable mechanism. In the illustrative embodiment of FIG. 1, for example, the raising and lowering mechanism 38 includes one or more of hydraulic cylinder assemblies 43 that are mounted between the turntable 42 and the ladder assembly 14. Each hydraulic cylinder assembly 43 is in fluid communication with a source of pressurized fluid and is operable to raise and lower the ladder assembly 14 with respect to the turntable 42 and the frame 15 of the vehicle. The extending and retracting mechanism 40 may include one or more hydraulic cylinder assemblies (not shown) that are mounted on the ladder assembly 14. Each hydraulic cylinder assembly may be operatively connected in a known manner between a pair of ladder sections of the ladder assembly 14 utilizing one or more associated cables. The hydraulic cylinder assemblies are in fluid communication with a source of pressurized hydraulic fluid and are operable to extend and retracted the ladder assembly 14. The turntable 42 may be rotated utilizing a hydraulic assembly.

Figure 2:
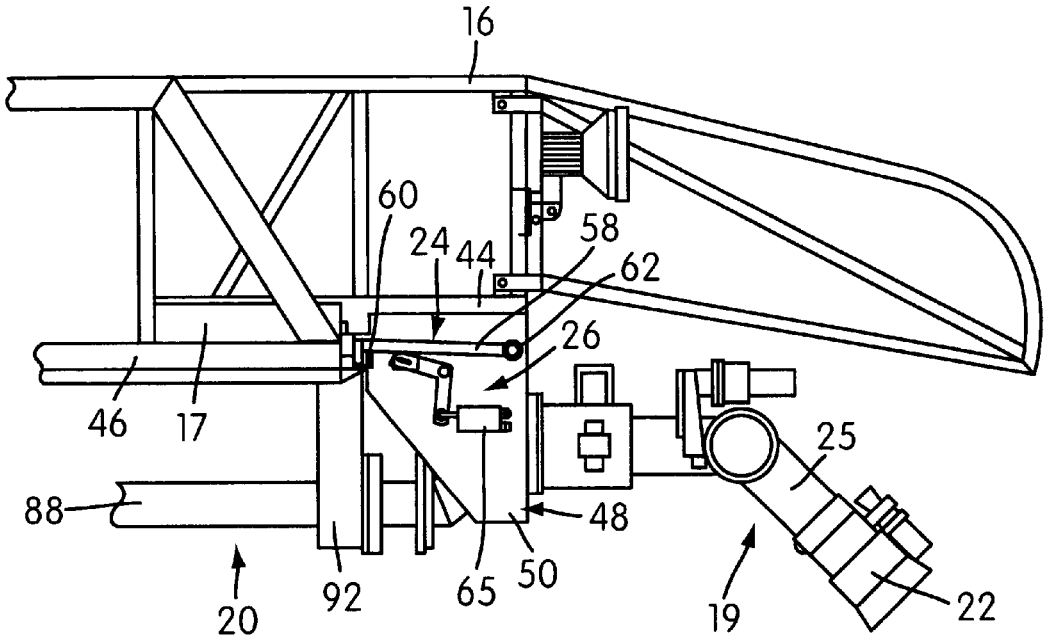
FIG. 2 is the side elevational view of an end portion of the aerial ladder assembly of FIG. 1 showing a waterway mounted thereon and a lock member connecting a water outlet support member of the waterway to a second ladder section of the aerial ladder assembly.
Figure 3:
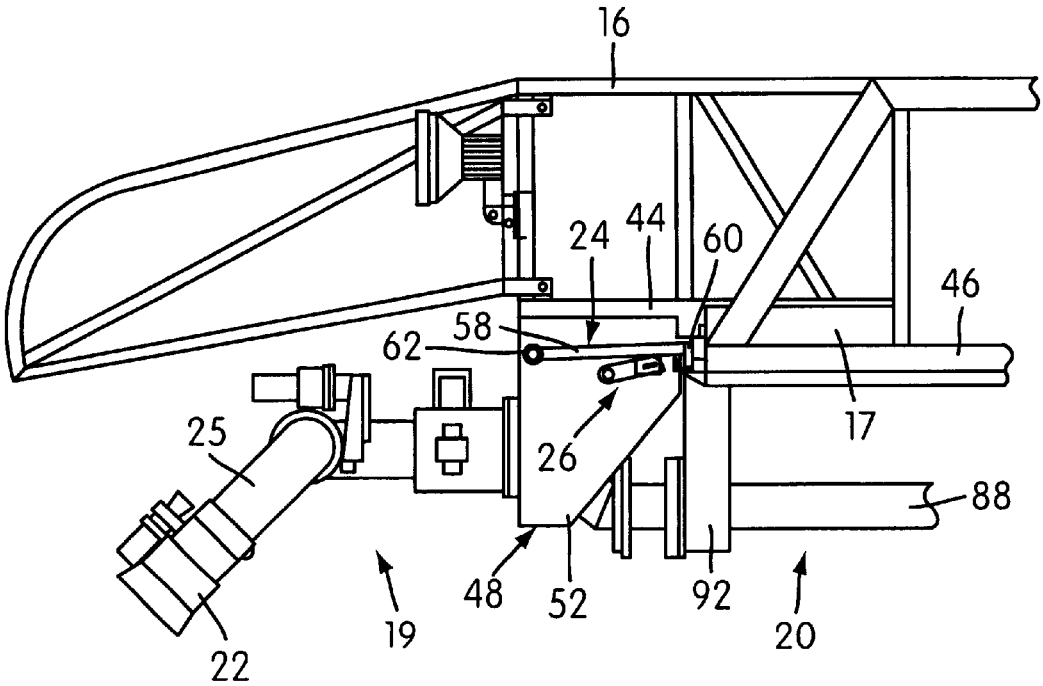
FIG. 3 is a view similar to FIG. 2 except showing a side elevational view of an opposite side of the aerial ladder assembly.

The top ladder section 16 includes a pair of longitudinally extending side rails 44 and a plurality of ladder rungs 45 extending between the side rails 44. Each side rail 44 of the top ladder section 16 includes an outwardly projecting support structure 47 that extends along the length thereof (see FIGS. 7, 8 and 14, for example). The intermediate ladder section 17 includes a pair of side rails 46 (see FIGS. 2 and 3).

The lock member 24, the actuator mechanism 26, the monitor 25 and the nozzle 22 are mounted on the ladder assembly 14 by the water outlet support member 48. The water outlet support member 48 may be a one-piece or a multi-piece structure constructed of a metal material such as a steel or any other suitable metallic material. The water outlet support member 48 includes a pair of side walls structures 50, 52 (see FIGS. 2, 3 and 14, for example) and a forward wall structure 54 extending therebetween (see FIGS. 6 and 14, for example). The water outlet support member 48 is supported by the top ladder section 16 and is operable to support the water outlet structure (i.e., the monitor 25 and the nozzle 22) and a portion of the tubular sections 88, 89. The monitor 25 and the nozzle 22 are mounted on the forward wall structure 54 of the water outlet support member 48.

Figure 14:
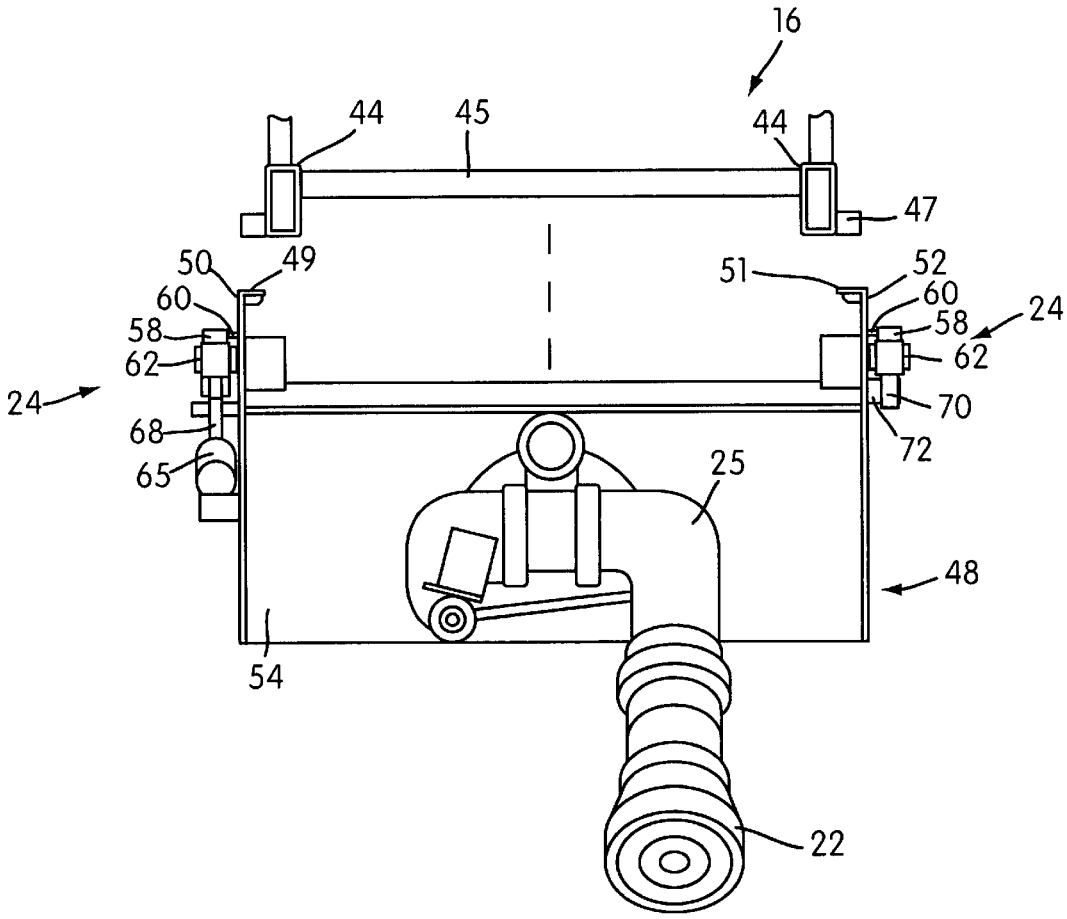
FIG. 14 is a partially exploded view showing the water outlet support member and the water outlet structure in exploded relation with a portion of the top ladder section.
Figure 15:
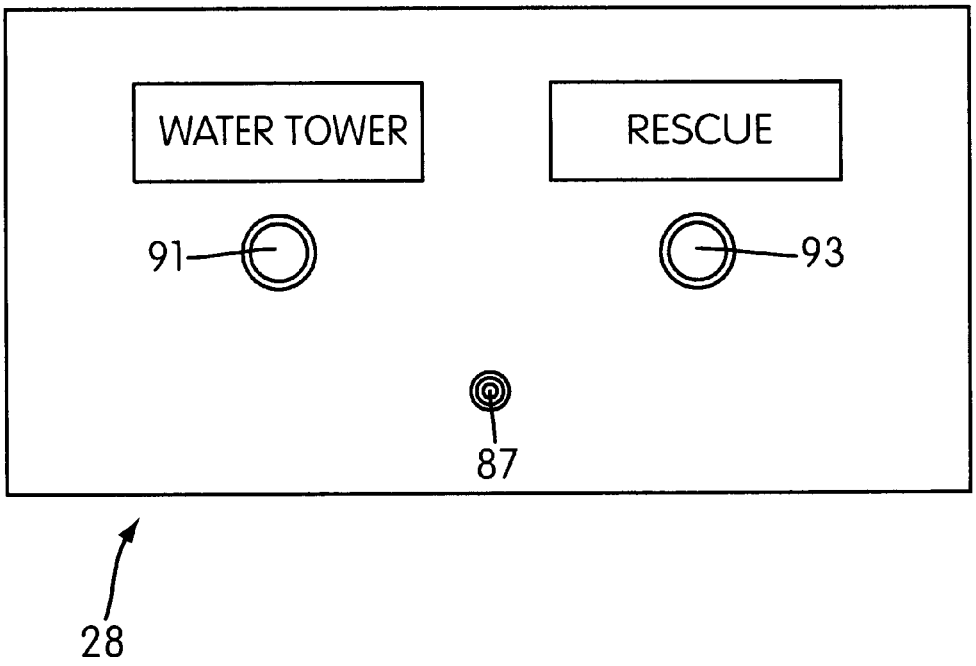
FIG. 15 shows an illustrative embodiment of a control panel that could be mounted at a location remote from the lock member for controlling the lock member.

The water outlet support member 48 is movably (e.g., rollingly or slidably) supported on the outwardly projecting support structure 47 of the side rails 44 of the top ladder section 16 utilizing a pair of flanges 49, 51 that extend inwardly from the top edges of the side wall structures 50, 52, respectively (see FIG. 14, for example). Each flange 49, 51 is movably supported on a respective support structure 47 on the top ladder section 16. The flanges 49, 51 of the water outlet support member 48 may be rollingly supported on the support structure 47, slidingly supported on the support structures 47, or supported for any other type of movement.

In the illustrative embodiment, a pair of lock members 24 are mounted on the side wall structures 50, 52, respectively. It can be appreciated that two lock members are not required and that one lock member, for example, or any number of lock members could be used. Each illustrative lock member 24 is an elongated rigid structure that may be constructed of a steel or other suitable metallic material. Each lock member 24 includes an arm portion 58. One end of each arm portion 58 is connected to pivot support structure 62 on the water outlet support member 48 for pivotal movement with respect to the water outlet support member 48. The pivot support structures 62 may be provided by a pair of rod-like structures which extend transversely outwardly from respective side wall structures 50, 52.

Specifically, each pivot structure 62 may be rigidly mounted on a side wall structure 50, 52 and the arm portion 58 of each lock member 24 may be pivotally mounted on a respective structure 62 so that the arm portions 58 pivot with respect to the water outlet support member 48. A recess-engaging structure which is illustrated in the form of a downwardly and inwardly extending pin or flange structure 60 is rigidly connected to the opposite end of each arm portion 58.

The actuator mechanism 26 includes an electric motor 64 (shown schematically in FIG. 13) that is mounted inside a housing 65. The housing 65 is fixedly mounted to the side wall structure 50 of the water outlet support member 48. A shaft of the motor 64 is coupled to a movable member 66 of the actuator mechanism 26 through a reduction gear assembly such that bi-directional rotational movement of the motor shaft moves the movable member 66 in and out of the housing 65. The illustrative actuator mechanism 26 functions, in effect, as an electrically powered piston.

As described below, the motor 64 is electrically connected to a power source 86 through a switch assembly 87 (see FIG. 13). The switch assembly 87 can be operated to drive the motor 64 in one of two rotational directions. When the electric motor 64 is driven in a first rotational direction, the motor shaft acting through the reduction gear assembly moves the movable member 66 out of the housing 65 to a fully extended position. When the electric motor 64 is driven in a second rotational direction, the motor shaft acting through the reduction gear mechanism moves the movable member 66 into the housing 65 to a fully retracted position.

The actuator mechanism 26 includes a pair of internal cut off switches 81, 83 (shown schematically in FIG. 13) that shut off the motor 64 when the movable member 66 moves into its fully retracted position or into its fully extended position.

Figure 4:
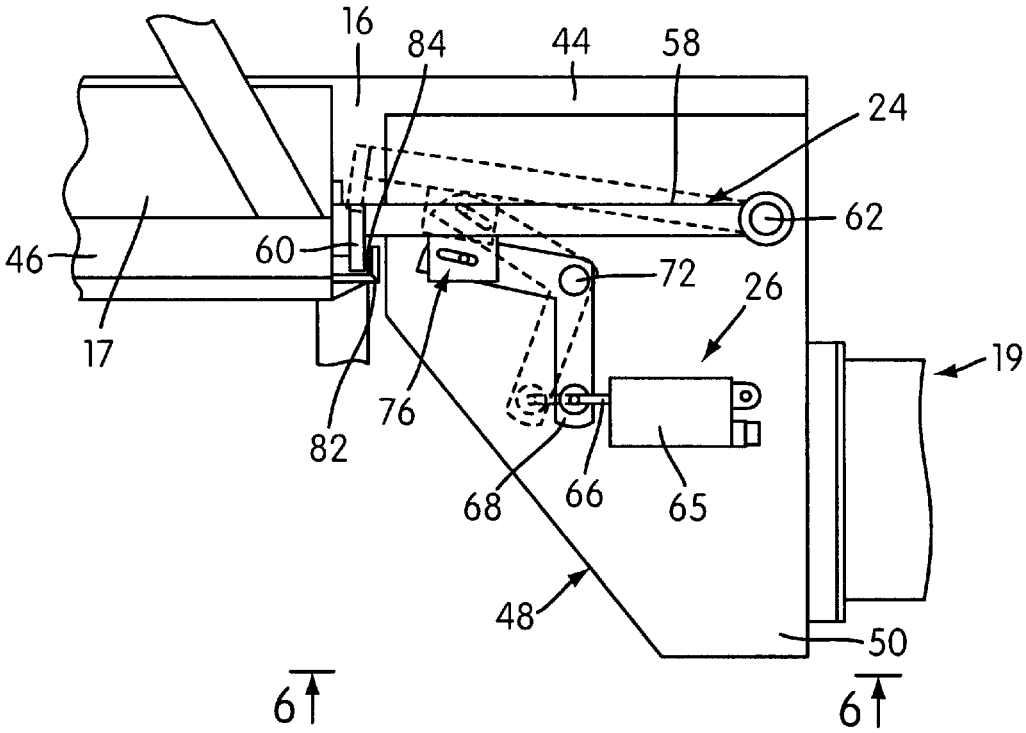
FIG. 4 shows the water outlet support member for mounting a water outlet structure of the waterway on the aerial ladder assembly and shows the lock member in solid lines connecting the water outlet support member to the second ladder section and showing the lock member in dashed lines connecting the water outlet support member to a top ladder section of the aerial ladder assembly.
Figure 5:
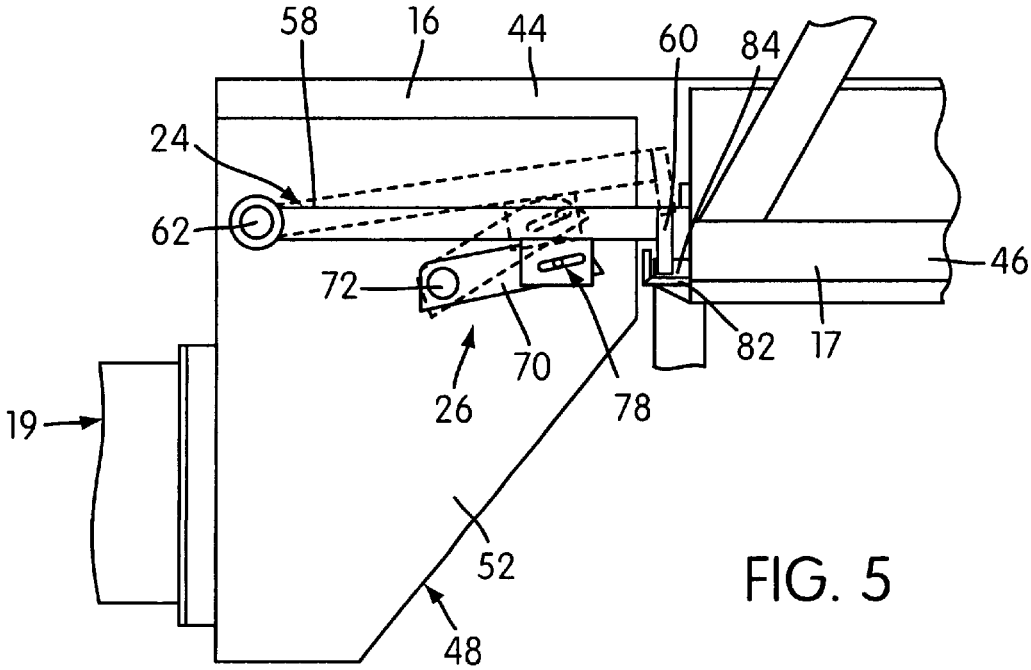
FIG. 5 is a view similar to FIG. 4 except showing a side elevational view of an opposite side of the water outlet support member.
Figure 6:
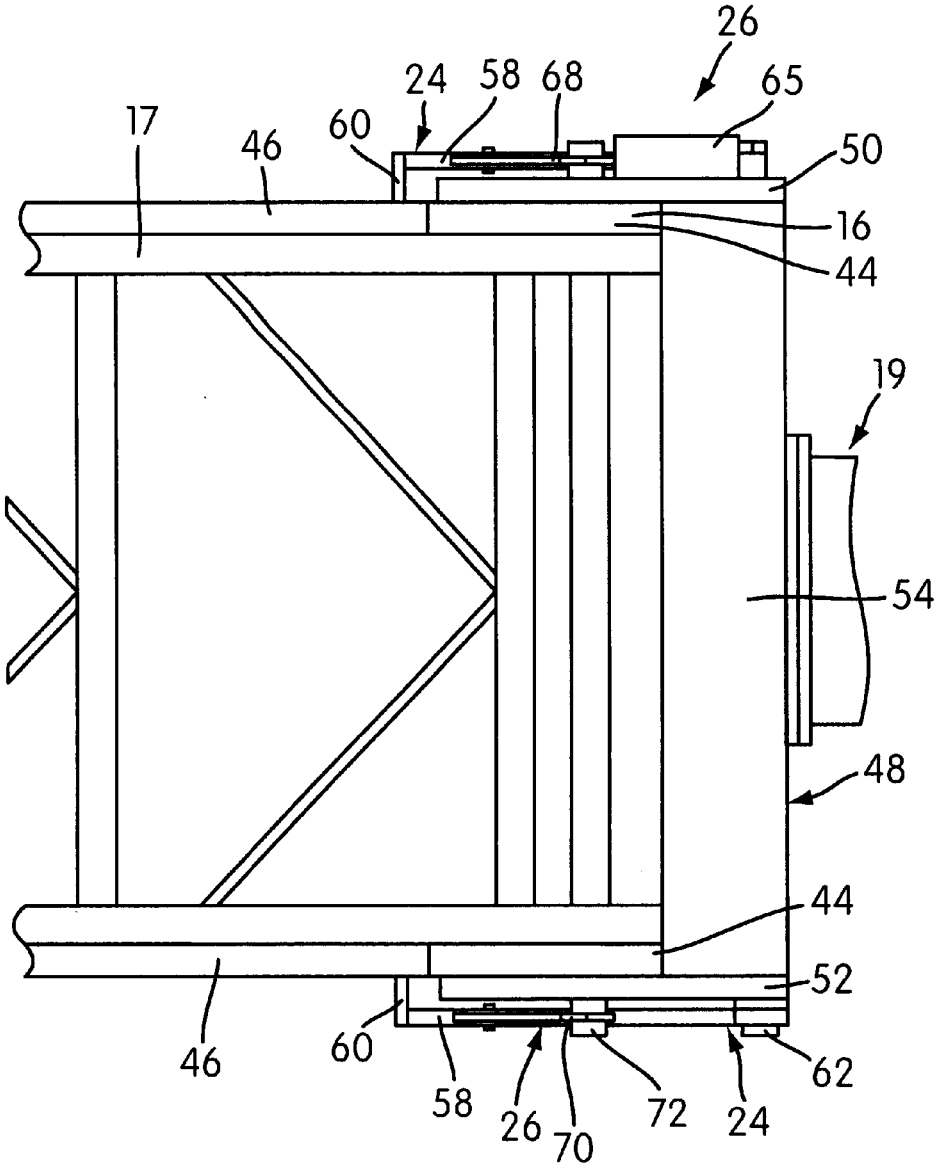
FIG. 6 is a bottom view of the water outlet support member taken generally along the line of the site 6—6 of FIG. 4.

The movable member 66 is operatively connected to the lock members 24 through linkage members 68, 70, respectively (see FIGS. 4, 5 and 6, for example). The linkage members 68, 70 are rigid structures which may be constructed of a steel, for example, or of other appropriate metallic material. The linkage member 68 is an angular structure.

The linkage members 68, 70 are rigidly secured to respective ends of a pivot rod 72. The rod 72 is mounted in the water outlet support member 48 for pivotal movement with respect thereto. One end of the linkage member 68 is pivotally coupled to the movable member 66 and an opposite end of the linkage member 68 is pivotally and slideably coupled to the associated lock member 24 by a pin and slot connection at 76. One end of the linkage member 70 is rigidly connected to the rod 72 and an opposite end of the linkage member 70 is pivotally and slideably coupled to the associated lock member 24 by a pin and slot connection at 78. The apparatus 10 can thus be constructed such that the linkage members 68, 70 are rigidly connected to the rod 72 so that the members 68, 70 and the rod 72 pivot as a unit with respect to the water outlet support member 48, although this is illustrative only and any method of operatively coupling the motor 64 to the lock members 24 can be used.

Each outwardly projecting support structure 47 includes a pin-receiving recess or slot 80 (see FIGS. 7, 8, 11 and 12, for example) for receiving the recess-engaging pin structure 60 of the associated lock member 24. An L-shaped bracket 82 (see FIGS. 4 and 5) is mounted on an outer end of each side rail 46 of the intermediate ladder section 17. Each bracket 82 is shaped to form a pin-receiving recess 84 for receiving the pin structure 60 of the associated lock member 24.

Figure 13:
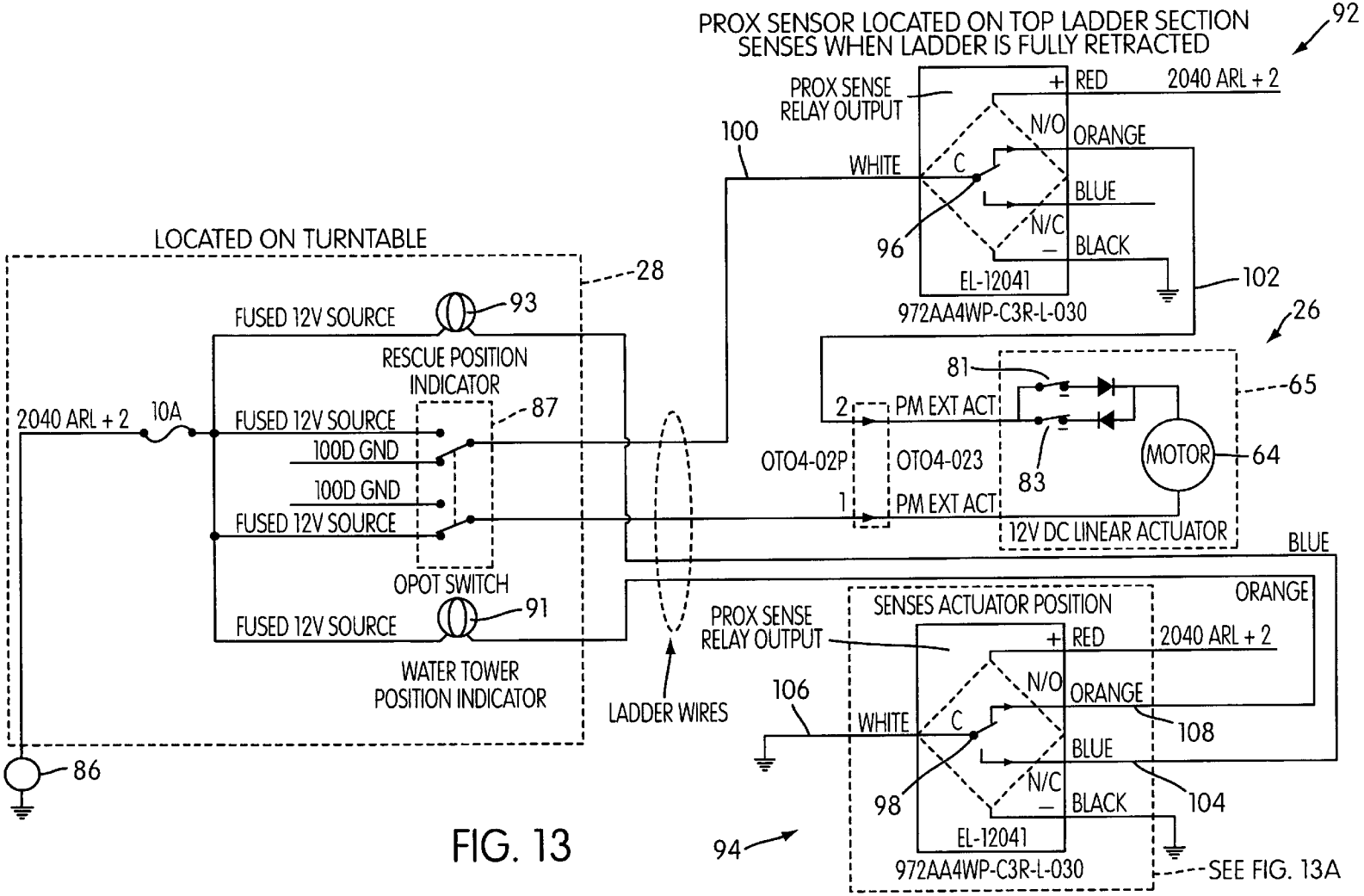
FIG. 13 is a schematic diagram showing a control system, a power supply and an actuator mechanism of the fire fighting apparatus.
Figure 13A:
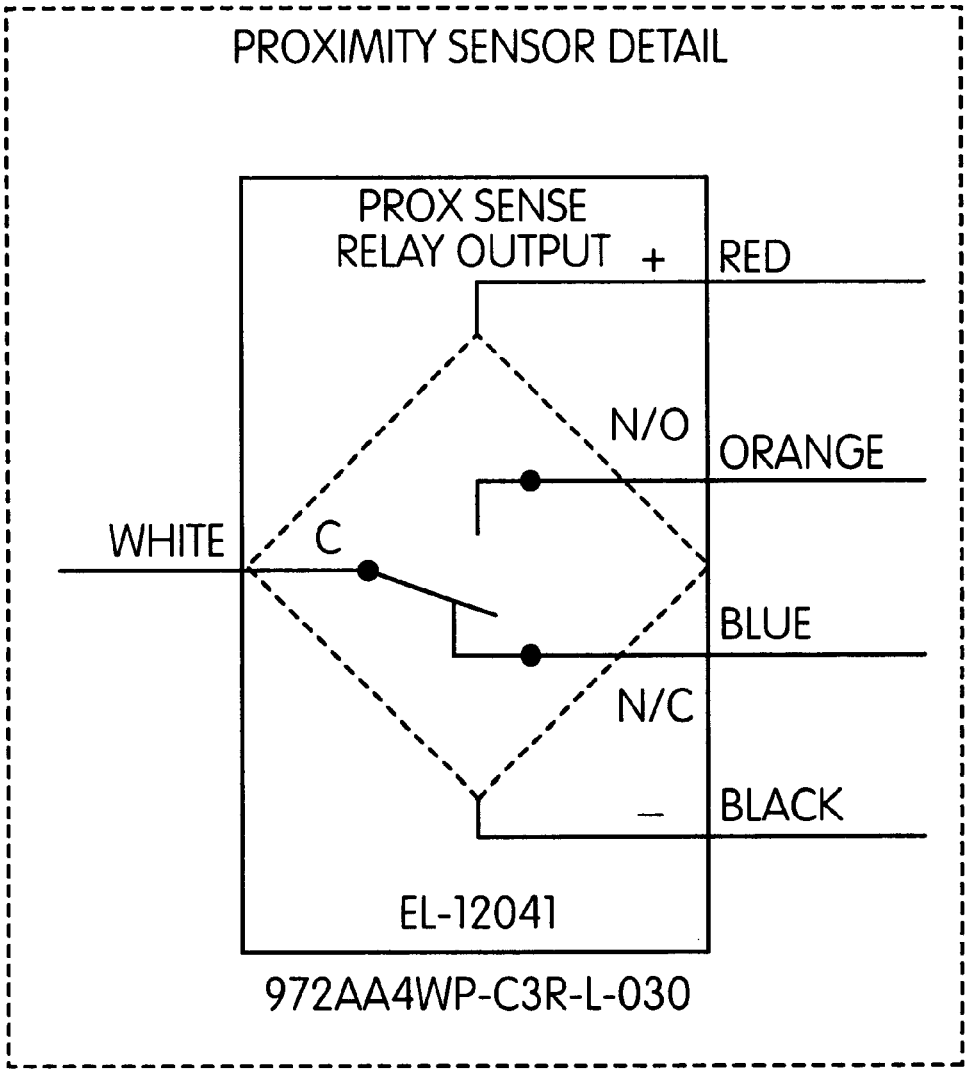
FIG. 13A is an enlarged view of a schematic drawing of a proximity switch as indicated in FIG. 13.

An illustrative embodiment of a system for controlling the lock members 24 is shown schematically in FIG. 13. The system includes a pair of proximity switches 92, 94, a switch assembly 87 and a power supply 86. The proximity switch 92 may be located on the top ladder section 16 of the ladder assembly 14 and is operable to prevent the position of the lock members from changing unless the ladder assembly 14 is in its fully retracted position. That is, the proximity switch 92 operates to prevent the actuator mechanism 26 from being energized unless the ladder assembly 14 is fully retracted. The proximity switch 94 may be mounted in operative relation to one of the lock members 24 or to one of the linkage members 68, 70 and is operable to sense or determine the position of the lock members 24 as explained below.

The electric motor 64 of the actuator mechanism 26 is in electrical communication with a power supply 86 through the switch assembly 87. The switch assembly 87 is a manually operable control that is operable to control the polarity of the electrical power supplied from the power source 86 to the motor 64. The power supply 86 may be provided by an electrical system of the aerial vehicle 12. The manually operable control 87 may be part of the control assembly 28.

The control assembly 28 may be located at any convenient location in or on the aerial vehicle 12 that is remote from the lock member 24. For example, the control assembly 28 may be located on the turntable 42, on the frame 15 of the aerial vehicle 12, or at any other convenient location. The control assembly 28 is mounted on the upstanding structure 29 on the turntable 42 of the swivel mechanism 41 in the illustrative embodiment (see FIG. 1). The switch assembly 87 is operable to affect and to control the movement of each lock member 24 by controlling the operation of the actuator mechanism 26.

The control assembly 28 may include, in addition to a switch assembly 87, a plurality of indicators 91, 93 that are operable, respectively, to indicate which of two positions the lock members 24 are in. The indicators 91, 93 are illustrated in the form of lights, but this is an example and not intended to be limiting. Other types of indicators could be used to indicate the position and condition of the lock members 24. Additional indicators may also be included in the control assembly 28 to indicate whether the lock members 24 are moving, and/or to indicate the direction in which the lock members 24 are moving.

OPERATION

The fire fighting apparatus 10 may be used for fighting many types of fires (e.g., a fire in a building or other structure). In the particular instance of a fire in a building, for example, the fire fighting apparatus 10 may be driven to the location of a fire and parked in the vicinity of a burning building so that the ladder assembly 14 is adjacent the building. Stablizers on the vehicle 12 may be deployed to stabilize the vehicle 12 to prevent movement or tipping of the vehicle 12 when the ladder assembly 14 is extended. The inlet connection end 23 of the waterway 19 may be fluidly connected to a source of a fire fighting fluid. For example, the inlet connect 23 may be connected directly to a fire hydrant or to a pump truck.

The fire fighters have a choice of where the water outlet structure (i.e., the monitor 25 and the nozzle 22 in the illustrative embodiment) of the waterway 19 will be located when the ladder assembly 14 is extended. In the illustrative vehicle 12, the monitor 25 and the nozzle 22 of the waterway 19 can be positioned at the top end of the top ladder section 16 of the extended ladder assembly 14 or the monitor 25 and the nozzle 22 can be positioned at the top end of the intermediate ladder section 17 of the extended ladder assembly 14. Generally, the fire fighters couple the water outlet support member 48 to the desired ladder section 16 or 17 and then move the ladder into its extended position. The coupling between the water outlet support member 48 to a ladder section 16, 18 determines the position of the nozzle 22 (and the monitor 25) when the ladder assembly 14 is extended. The coupling between the water outlet support member 48 and the ladder sections can be changed when the ladder assembly 14 is in its retracted position. The ladder assembly 14 can be in its storage position or in a raised, upwardly angled position when the coupling is changed.

For example, the raising and lowering mechanism 38 may be operated to pivot the retracted ladder assembly 14 upwardly out of its stored position so that the retracted ladder assembly 14 extends angularly and upwardly from the rearward upper deck 32 of the aerial vehicle 12. A fire fighter may then operate the control assembly 28 to releaseably engage the water outlet support member 48 with a selected ladder section.

The positioning of the controls 28 remote from the lock members 24 enables the fire fighter to determine and change the coupling between the water outlet support member 48 and the ladder assembly 14 without having to climb on or climb up the ladder assembly 14. This is safer for fire fighters, is more efficient, and saves time when fighting fires. Because the control assembly 28 is mounted at a location remote from the lock members 24, the control assembly 28 can be positioned to enable a fire fighter to stand on the ground, for example, on the frame of the vehicle 12 or on the turntable 42 to change the coupling between the two lock members 24 and the top and intermediate ladder sections 16, 17.

The control assembly 28 and the controls for operating the ladder mounting and operating assembly 34 may be located at a common location on the fire fighting apparatus 10 for convenience so that a single operator standing on the turntable 42, on the ground or on the frame 15 of the vehicle 12 at a location remote from the ladder assembly 14 can operate both the ladder assembly 14 and the lock members 24.

The fire fighter can determine the position of the lock members 24 with respect to the ladder assembly 14 by looking at appropriate indicator lights 91, 93 on the control assembly 28. When the water outlet support member 48 is coupled to the top ladder section 16, the indicator light 91 is on. When the nozzle 22 is located at the top of the extended ladder assembly 14, the ladder assembly 14 may be said to be in its "water tower" configuration. When the water outlet support member 48 is coupled to the intermediate ladder section 17, the indicator light 93 is on. When the nozzle 22 is located at an intermediate position on the extended ladder assembly 14, the ladder assembly 14 may be said to be in its "rescue" configuration.

If the fire fighter determines that the position of the lock members 24 should be changed, the fire fighter can reposition the lock members 24 with respect to the ladder assembly 14 from the remote location. The fire fighter is able to use the indicator lights 91, 93 to verify from the remote location that the lock members 24 are in the desired position.

The switch assembly 87 is illustrated as a double pole, double throw (DPDT) toggle switch (see FIG. 13). When the switch assembly 87 is moved from a first switch position to a second switch position, the polarity of the voltage and current supplied from the power source 86 to the actuator mechanism 26 is reversed. When the power sent to the actuator mechanism 26 changes polarity, the motor 64 is turned on. The motor is driven in a direction determined by the polarity of the power from the power source 86. The energized motor drives the movable member 66 from a first position (retracted or extended) to a second position (retracted or extended). The movement of the movable member 66 from a first position to a second position turns the motor 64 off (through the operation of switches 81, 83). The actuator mechanism 26 remains off until the polarity of the power is reversed.

Each proximity switch 92, 94 includes a relay switch 96, 98, respectively, that has a closed or first switch position and an open or second switch position. The proximity switch 92 functions to allow the actuator mechanism 26 to be energized only when the ladder assembly 14 is in its retracted position. More specifically, when the ladder assembly 14 is in its retracted position, the proximity of the top ladder section 16 to the proximity switch 92 causes the relay 96 to move into a first or closed switch position. In this closed switch position the conductor 100 is in electrical contact with a conductor 102. When the ladder assembly 14 is extended (partially or fully), the switch 96 is in a second or open switch position in which the conductor 100 is in electrical contact with a conductor 104 on the proximity switch 92. In this second or open switch position, the electrical path between the switch 87 and the actuator mechanism 26 is open so that the motor 64 cannot be energized by the power source 86. When the proximity switch 92 is in its first or closed switch position, the electrical path between the switch 87 and the actuator mechanism 26 is closed.

When the proximity switch 92 is closed (indicating that the ladder assembly 14 is in its retracted position) and the actuator mechanism 26 is off, the actuator mechanism 26 can be energized by changing the position of the switch 87. It can be appreciated with FIG. 13 that changing the position of the switch 87 reverses the polarity of the signal sent to the actuator mechanism 26. When the movable member 66 changes its position from a first position to a second position (i.e., from its fully retracted position to its fully extended position or from its fully extended position to it fully retracted position), movement of the movable member 66 trips a switch 81, 83, causing the motor to de-energize, even though power is still applied to the actuator mechanism 26 by the switch 87. The actuator mechanism 26 remains off until the polarity of the signal from the power source 86 reverses.

Movement of the movable member 66 between its extended and retracted positions moves the lock member 24 between its first and second positions. The proximity switch 94 is positioned so that movement of the lock member 24 changes the lighting conditions of the indicator lights 91 and 93, causing one to turn on and the other to turn off.

For example, when the lock member 24 is coupled to the intermediate ladder section 17, the water outlet support member 48 and the nozzle 22 are in the rescue position when the ladder assembly 14 is extended. In this instance, the indicator light 93 is on and the light 91 is off. More specifically, when the lock member 24 is coupled to the intermediate ladder section 17, the proximity switch 94 is positioned relative to the lock member 24 so that the relay 98 in the proximity switch 94 creates a conductive path between conductors 104 and 106. This creates a voltage drop across light 93 causing it to light up. At the same time, the path between conductor 106 and conductor 108 is open, causing the light 91 to remain off.

When the position of the lock member 24 changes so that the lock member 24 is coupled to the top ladder section 16, conductors 106 and 108 are connected which causes a voltage drop across the light 91 and the conductors 106 and 104 are disconnected, which turns the light 93 off.

It can be appreciated that the manner in which a particular system is wired depends on a number of factors, including the positioning of the proximity switches 92, 94 relative to the sections of the ladder assembly 14 and relative to the lock member 24, respectively.

As an example of the operation, if the lock members 24 of the retracted ladder assembly 14 are releasably engaged with the intermediate ladder section 17 and the fire fighter wants to releasably engage the lock members 24 with the top ladder section 16 so that the water outlet support member 48 is positioned at the top end of the top ladder section 16 when the ladder assembly 14 is moved to its extended position, the fire fighter can reposition the lock members 24 using the remote control assembly 28. More specifically, the switch assembly 87 of the control assembly 28 can be operated to cause the electric motor 64 to move each lock member 24 from a second position in which the recess-engaging pin structure 60 on each lock member 24 is disposed within the associated pin-receiving recess 82 of the intermediate ladder section 17 to a first position in which the pin structure 60 on each lock member 24 is disposed within the associated pin-receiving recess 80 on the top ladder section 16. These second and first positions are shown in solid lines and dashed lines, respectively, in FIGS. 4 and 5.

The energy source 86 energizes the motor 64 causing the movable member 66 to move from its retracted position to its extended position. Movement of the movable member 66 toward and into its extended position causes the link members 68, 70 to pivot in a first direction which in turn pivots the lock members 24 in a first direction toward and into the first locking position in which the lock members 24 are coupled to the recesses 80 on the top ladder section 16. Movement of the movable member 66 into its extended position turns the motor off. Movement of the lock members into their first position in locking engagement with the top ladder section 16 causes the light 91 to light up and the light 93 to turn off.

Figure 9:
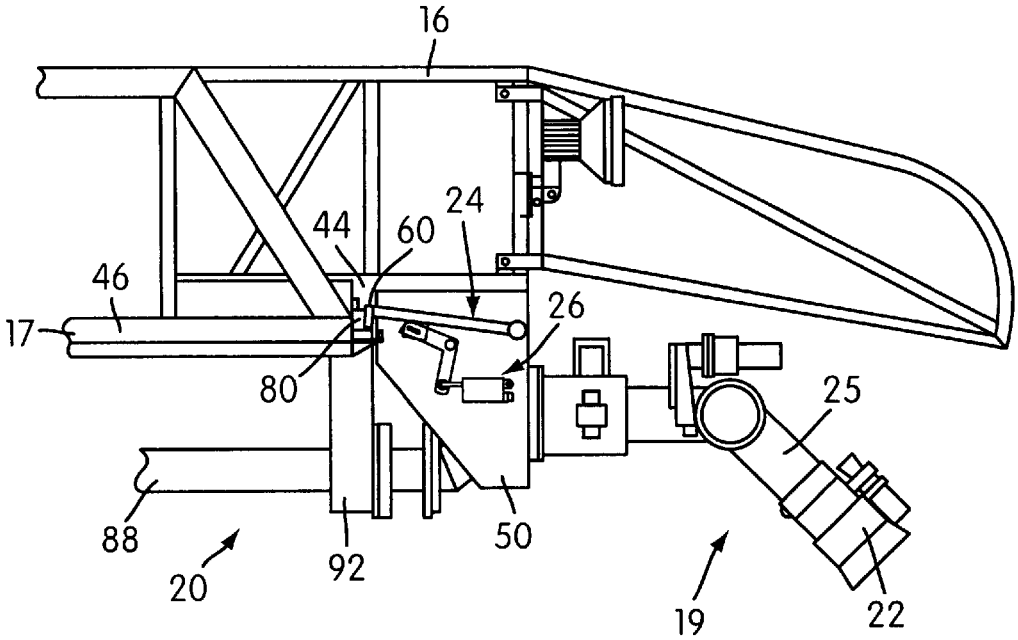
FIG. 9 is a view similar to the view of FIG. 2 except showing the lock member connecting the water outlet support member to the top ladder section.
Figure 10:
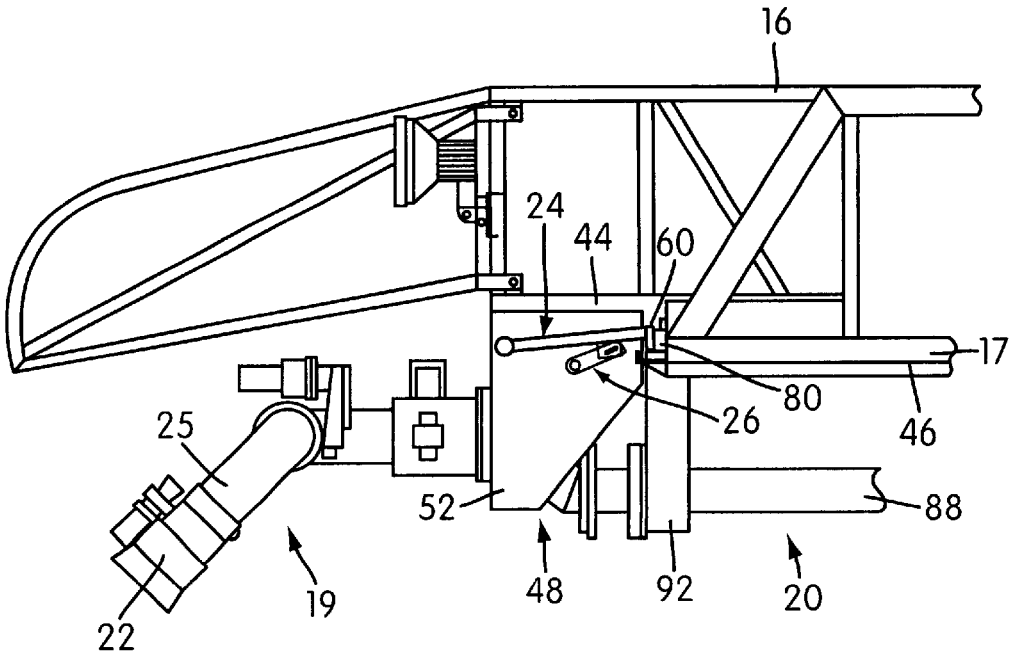
FIG. 10 is a view similar to the view of FIG. 9 except showing an opposite side of the ladder assembly.

When the pin structure 60 on each lock member 24 is disposed within the associated pin-receiving recess 80 on the top ladder section 16 (see FIGS. 9 and 10, for example), the water outlet support member 48 is releasably locked to the top ladder section 16. As the top ladder section 16 extends outwardly with respect to the intermediate ladder section 17, the water outlet support member 48 is carried with the top ladder section 16 and moves outwardly away from the intermediate ladder section 17 (see FIGS. 11 and 12, for example). The water outlet support member 48 is positioned at the outermost tip of the ladder assembly 14 as the ladder assembly 14 moves toward and into its fully extended position. As the water outlet support member 48 moves outwardly from the intermediate ladder section 17, the tubular section 89 of the waterway 19 moves telescopically outwardly of the tubular section 88.

To disengage the water outlet support member 48 from the top ladder section and engage the water outlet support member 48 with the intermediate ladder section 17, the fire fighter moves the ladder assembly 14 to its retracted position. The fire fighter then uses switch assembly 87 to move the pin structures 60 on the lock members 24 into the pin-receiving recesses 82 on the intermediate ladder section 17 (see, for example, FIGS. 2 and 3). In this second position, the lock members 24 releasably lock the water outlet support member 48 to the intermediate ladder section 17.

Figure 7:
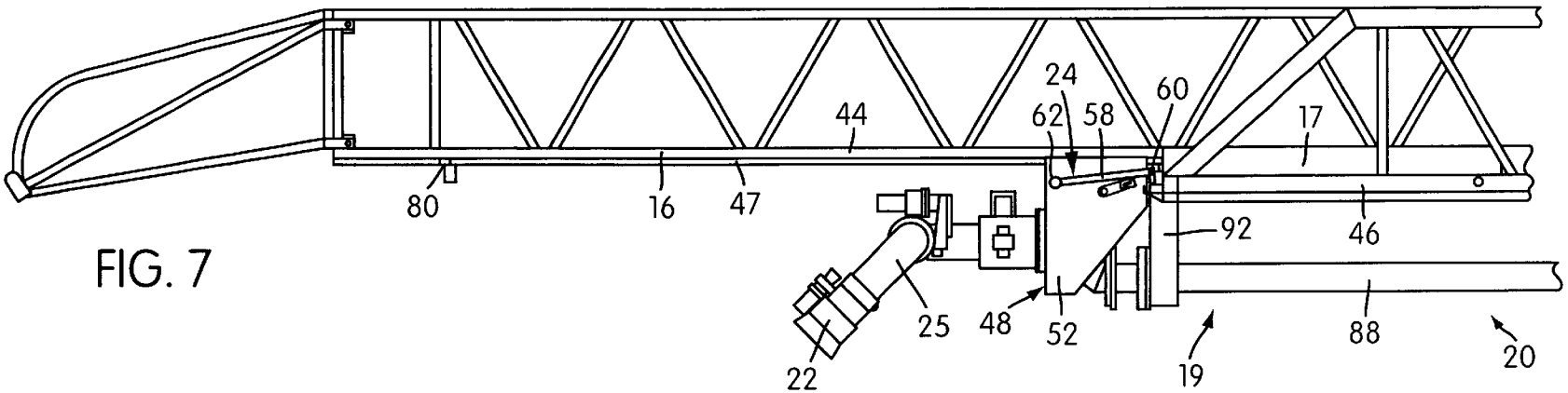
FIG. 7 is a view similar to the view of FIG. 2 except showing the top ladder section of the ladder assembly partially extended.
Figure 8:
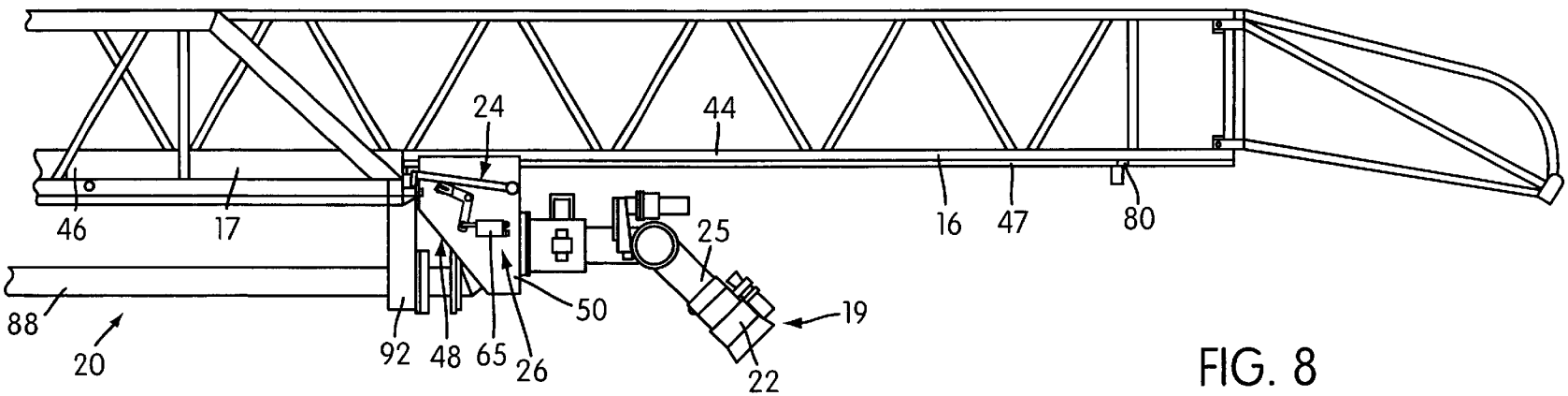
FIG. 8 is a view similar to the view of FIG. 7 except showing an opposite side of the ladder assembly.

As the top ladder section 16 is extended relative to the intermediate ladder section 17, the water outlet support member 48 remains attached to the intermediate ladder section 17 (see FIGS. 7 and 8). As the top ladder section 16 moves outwardly with respect to the intermediate ladder section 17, the outwardly projecting support structures 47 in the top ladder section 16 move (e.g., with a sliding or rolling engagement) outwardly past the water outlet support member 48. When the ladder assembly 14 is fully extended, the nozzle 22 is positioned at the end of the intermediate ladder section 17 and the ladder assembly 14 has a clean tip. Thus, when the free upper end of the ladder assembly 14 is placed against a building, people can climb between the top ladder section 16 and the building without interference from the nozzle 22 or the water outlet support member 48. For example, fire victims trapped on upper floors can climb onto and down the ladder to escape a fire or fire fighters can climb in and out of a building without interference from the nozzle 22 or the water outlet support member 48. FIGS. 4 and 5 illustrate the movement of each lock member 24 from locking engagement with the intermediate ladder section 17 to locking engagement with the top ladder section 16.

While the invention has been disclosed and described with reference to a limited number of embodiments, it will be apparent that variations and modifications may be made thereto without departure from the spirit and scope of the invention and various other modifications may occur to those skilled in the art. Therefore, the following claims are intended to cover modifications, variations, and equivalents thereof.

What is claimed:

1. An aerial type fire fighting apparatus, comprising:

a frame rollingly supported by a plurality of wheels for enabling said apparatus to be transported to a location of a fire;

an extendible and retractable ladder assembly comprising at least two ladder sections including a top ladder section, said ladder sections being movably mounted to one another such that in each pair of adjacent ladder sections an upper one of said pair can be extended and retracted relative to a lower one of said pair to thereby affect extension and retraction of said ladder assembly, said ladder assembly being movably mounted for raising and lowering movements between a generally horizontal stored position on said frame and a raised position wherein said ladder assembly extends upwardly at an angle from said frame;

a power-operated ladder raising and lowering mechanism operatively connected to said ladder assembly, said ladder raising and lowering mechanism being constructed and arranged to move said ladder assembly under power between said generally horizontal stored position thereof and said raised position thereof;

a power-operated ladder extending and retracting mechanism operatively connected to said ladder assembly, said ladder extending and retracting mechanism being constructed and arranged to extend and retract said ladder sections under power to thereby affect extension and retraction of said ladder assembly;

a waterway comprising a water outlet support member coupled to said ladder assembly, a water outlet structure supported on said water outlet support member, and a fluid inlet connection, said fluid inlet connection being configured to receive pressurized fire fighting fluid from a fire fighting fluid source and being in fluid communication with said water outlet structure so that fire fighting fluid received by said fluid inlet connection is transmitted to said water outlet structure, said water outlet structure being constructed and arranged to emit the fire fighting fluid outwardly therefrom;

a lock member movable between (a) a first position in which said lock member couples said water outlet structure, said water outlet support member and said top ladder section to one another such that said water outlet support member and said water outlet structure move with said top ladder section as said top ladder section is extended and retracted relative to its adjacent ladder section, and (b) a second position in which said water outlet support member and said water outlet structure are disconnected from said top ladder section to enable said water outlet support member and said water outlet structure to remain substantially stationary with respect to said ladder section adjacent said top ladder section as said top ladder section is extended and retracted relative to its adjacent ladder section; and a remotely controlled actuator mechanism having a manually operable control mounted on said frame at a location remote from said lock member, said actuator mechanism being operatively connected to said lock member and being constructed and arranged to move said lock member between said first and second positions thereof responsive to remote manual operation of said manually operable control.

2. An aerial type fire fighting apparatus according to claim 1, said water outlet structure comprising a monitor.

3. An aerial type fire fighting apparatus according to claim 2, said water outlet structure further comprising a nozzle mounted on said monitor.

4. An aerial type fire fighting apparatus according to claim 1, further comprising a power-operated swivel mechanism rotatably mounted on said frame, said ladder assembly, said raising and lowering mechanism, and said extending and retracting mechanism being mounted on said swivel mechanism, said swivel mechanism being constructed and arranged to rotate said ladder assembly with respect to said frame.

5. An aerial type fire fighting apparatus according to claim 4, wherein said actuator mechanism includes an electrical motor operatively connected to said lock member, said electric motor being operable to move said lock member between the first and second positions thereof.

6. An aerial type fire fighting apparatus according to claim 5, wherein said manually operable control includes a manually operable switch operable to control transmission of electrical power from a power supply to said electrical motor and thereby control the operation of said lock member to move said lock member between the first and second positions thereof.

7. An aerial type fire fighting apparatus according to claim 6, wherein said manually operable switch is mounted on said frame at a location remote from said ladder assembly.

8. An aerial type fire fighting apparatus according to claim 7, wherein said manually operable switch is part of a control assembly for controlling operation of said lock member, said control assembly further including a plurality of indicators operable to indicate the position of the lock member to enable an operator in a location remote from the lock member to determine whether the lock member is in its first position or its second position.

9. An aerial type fire fighting apparatus according to claim 8, wherein each indicator is an indicator light.

10. An aerial type fire fighting apparatus according to claim 9, wherein said control assembly is mounted on said swivel mechanism.

11. An aerial type fire fighting apparatus according to claim 10, said waterway further comprising a plurality of telescopically interengaged tubular sections mounted on said ladder assembly and being constructed and arranged to extend and retract as said ladder assembly is moved between extended and retracted conditions to provide a continuous passageway along said ladder assembly for fire fighting fluid, said plurality of telescopically interengaged tubular sections being operable to receive fire fighting fluid transmitted from said fluid inlet connection and to transmit said fire fighting fluid to said water outlet structure.

12. An aerial type fire fighting apparatus according to claim 9, further comprising a plurality of ladder movement control mechanisms operable to control said raising and lowering mechanism, said extending and retracting mechanism and said swivel mechanism, said ladder movement control mechanisms being mounted on said frame adjacent said control assembly for controlling said lock member so that an operator standing by said ladder movement control mechanisms and said control assembly can control the operation of said lock member, said raising and lowering mechanism, said extending and retracting mechanism, and said swivel mechanism from a single location remote from said ladder assembly.

13. An aerial type fire fighting apparatus according to claim 10, further comprising a pedestal mounted on said swivel mechanism adjacent said ladder assembly, said control assembly and said ladder movement control mechanisms being mounted on said pedestal.

14. An aerial type fire fighting apparatus according to claim 13, said power-operated ladder raising and lowering mechanism including one or more hydraulic cylinder assemblies operatively connected to said ladder assembly, each hydraulic cylinder assembly of said raising and lowering mechanism being in fluid communication with a source of pressurized hydraulic fluid and being operable to raise and lower said ladder assembly with respect to said frame.

15. An aerial type fire fighting apparatus according to claim 1, wherein said water outlet support member is supported by said top ladder section and is constructed and arranged such that when said lock member is in its first position, said water outlet support member is releasably locked to the upper end of said top ladder section so that said water outlet structure is positioned at the upper end of said top ladder section when said top ladder section is in its extended position.

16. An aerial type fire fighting apparatus according to claim 15, said water outlet support member and said lock member being further constructed and arranged such that said lock member in the second position thereof releasably locks said water outlet support member to said adjacent ladder section adjacent said top ladder section.

17. An aerial type fire fighting apparatus according to claim 16, wherein said apparatus is further constructed and arranged such that when said lock member is in its second position, said water outlet support member is releasably locked to an upper end of said adjacent ladder section adjacent said top ladder section so that when said top ladder section is in its extended position, said water outlet structure is positioned at the upper end of said adjacent ladder section adjacent said top ladder section.

18. An aerial type fire fighting apparatus according to claim 17, wherein said lock member is mounted on said water outlet support member for movement between the first and second positions thereof.

19. An aerial type fire fighting apparatus according to claim 18, wherein said lock member is pivotally mounted on said water outlet support member and constructed and arranged such that when said lock member is in its first position, recess-engaging structure on said lock member is releasably engaged within a recess in said top ladder section to releasably lock said lock member with said top ladder section and such that when said lock member is in its second position, said recess-engaging structure on said lock member is releasably engaged within a recess in said adjacent ladder section adjacent said top ladder section to releasably lock said water outlet support member to said adjacent ladder section.

20. An aerial type fire fighting apparatus according to claim 15, wherein said water outlet support member is rollingly supported on said top ladder section.

21. An aerial type fire fighting apparatus according to claim 15, wherein said water outlet support member is slidingly supported on said top ladder section.

22. An aerial type fire fighting apparatus according to claim 15, wherein said electric motor is mounted on said water outlet support member.

* * * * *